US008212756B2

(12) United States Patent
Shiomi et al.

(10) Patent No.: US 8,212,756 B2
(45) Date of Patent: Jul. 3, 2012

(54) DISPLAY PANEL DRIVING APPARATUS, DISPLAY PANEL DRIVING METHOD, DISPLAY APPARATUS, AND TELEVISION RECEIVER

(75) Inventors: Makoto Shiomi, Tenri (JP); Toshihisa Uchida, Suzuka (JP)

(73) Assignee: Sharp Kabushiki Kaisha, Osaka (JP)

( * ) Notice: Subject to any disclaimer, the term of this patent is extended or adjusted under 35 U.S.C. 154(b) by 889 days.

(21) Appl. No.: 12/224,856

(22) PCT Filed: Jan. 15, 2007

(86) PCT No.: PCT/JP2007/050393

§ 371 (c)(1),
(2), (4) Date: Sep. 8, 2008

(87) PCT Pub. No.: WO2007/122825

PCT Pub. Date: Nov. 1, 2007

(65) Prior Publication Data

US 2009/0201238 A1 Aug. 13, 2009
US 2012/0119981 A1 May 17, 2012

(30) Foreign Application Priority Data

Apr. 14, 2006 (JP) ..... 2006-112782

(51) Int. Cl.
*G09G 3/36* (2006.01)

(52) U.S. Cl. ..... 345/89; 345/690; 345/204

(58) Field of Classification Search ..... None
See application file for complete search history.

(56) References Cited

U.S. PATENT DOCUMENTS 7,391,391 B2 6/2008 Ohshima
2001/0038369 A1 11/2001 Adachi et al.
(Continued)

FOREIGN PATENT DOCUMENTS

CN 1571008 1/2005
(Continued)

OTHER PUBLICATIONS

U.S. Office Action dated Sep. 12, 2011 for U.S. Appl. No. 12/224,828.
(Continued)

*Primary Examiner* — Nitin Patel
*Assistant Examiner* — Christopher Thompson
(74) *Attorney, Agent, or Firm* — Harness, Dickey & Pierce, P.L.C.

(57) ABSTRACT

In a display panel driving apparatus which generates, based on an input gray scale, a gray scale of a first sub-frame and a gray scale of a second sub-frame so as to display the input gray scale as a result of a summation of respective display corresponding to the first sub-frame and the second sub-frame into which one frame is divided, and the gray scale of the second sub-frame being greater than the gray scale of the first sub-frame, for a response in which (i) the input gray scale of a subsequent frame is greater than an input gray scale of a previous frame and (ii) the input gray scale of the subsequent frame is not less than a first threshold gray scale, a gray scale of the first sub-frame in the subsequent frame is set not more than a second threshold gray scale, regardless of input gray scale of the subsequent frame. Thus, it is possible to reduce jaggy in an edge of a moving image in time-division driving.

10 Claims, 14 Drawing Sheets

U.S. PATENT DOCUMENTS

| | | | | |
|---|---|---|---|---|
| 2002/0044115 | A1 | 4/2002 | Jinda et al. | |
| 2003/0048247 | A1 | 3/2003 | Ham | |
| 2003/0156092 | A1 | 8/2003 | Suzuki et al. | |
| 2004/0017343 | A1 | 1/2004 | Adachi et al. | |
| 2004/0196229 | A1 | 10/2004 | Ham | |
| 2004/0196274 | A1 | 10/2004 | Song et al. | |
| 2005/0140626 | A1 | 6/2005 | Doyen et al. | |
| 2005/0162360 | A1 | 7/2005 | Ishihara et al. | |
| 2005/0200619 | A1 | 9/2005 | Adachi et al. | |
| 2006/0022922 | A1 | 2/2006 | Jinda et al. | |
| 2006/0038837 | A1 | 2/2006 | Hong | |
| 2006/0125748 | A1 | 6/2006 | Yang et al. | |
| 2006/0256141 | A1* | 11/2006 | Maruyama et al. | 345/690 |
| 2007/0018934 | A1* | 1/2007 | Kim et al. | 345/98 |
| 2008/0211755 | A1 | 9/2008 | Song et al. | |
| 2009/0121994 | A1 | 5/2009 | Miyata | |
| 2010/0164996 | A1* | 7/2010 | Tomizawa et al. | 345/690 |

FOREIGN PATENT DOCUMENTS

| | | |
|---|---|---|
| JP | 2001-343956 | 12/2001 |
| JP | 2002-116743 | 4/2002 |
| JP | 2003-084742 | 3/2003 |
| JP | 2003-241721 | 8/2003 |
| JP | 2004-264725 | 9/2004 |
| JP | 2004-310113 | 11/2004 |
| JP | 2005-003897 | 1/2005 |
| JP | 2005-043875 | 2/2005 |
| JP | 2007-078860 | 3/2007 |

OTHER PUBLICATIONS

U.S. Notice of Allowance mailed Jan. 17, 2012 for U.S. Appl. No. 12/224,828.

* cited by examiner

FIG. 6

| DSFn1(GRAY SCALE OF FIRST SUB-FRAME T1) | | | | | | | | | | |
|---|---|---|---|---|---|---|---|---|---|---|
| | | DFn(Tr) | | | | | | | | |
| | | 0 | 32 | 64 | 96 | 128 | 160 | 192 | 224 | 255 |
| DFn-1 (Tf) | 0 | 0 | 1 | 2 | 3 | 4 | 5 | 6 | 7 | 8 |
| | 32 | 31 | 32 | 32 | 33 | 34 | 35 | 36 | 37 | 40 |
| | 64 | 62 | 64 | 64 | 64 | 65 | 66 | 67 | 68 | 70 |
| | 96 | 94 | 96 | 96 | 96 | 96 | 96 | 96 | 96 | 96 |
| | 128 | 126 | 128 | 128 | 128 | 128 | 128 | 128 | 128 | 128 |
| | 160 | 157 | 159 | 160 | 160 | 160 | 160 | 160 | 160 | 160 |
| | 192 | 188 | 190 | 192 | 192 | 192 | 192 | 192 | 192 | 192 |
| | 224 | 220 | 222 | 224 | 224 | 224 | 224 | 224 | 224 | 224 |
| | 255 | 248 | 252 | 253 | 255 | 255 | 255 | 255 | 255 | 255 |

FIG. 7

| DSFn2(GRAY SCALE OF SECOND SUB-FRAME T2) | | | | | | | | | | |
|---|---|---|---|---|---|---|---|---|---|---|
| | | DFn(Tr) | | | | | | | | |
| | | 0 | 32 | 64 | 96 | 128 | 160 | 192 | 224 | 255 |
| DFn-1 (Tf) | 0 | 0 | 134 | 156 | 182 | 198 | 224 | 240 | 255 | 255 |
| | 32 | 0 | 32 | 82 | 126 | 150 | 204 | 232 | 240 | 255 |
| | 64 | 0 | 11 | 64 | 115 | 152 | 199 | 230 | 248 | 255 |
| | 96 | 0 | 6 | 16 | 96 | 140 | 191 | 227 | 246 | 255 |
| | 128 | 0 | 4 | 8 | 72 | 128 | 181 | 220 | 242 | 255 |
| | 160 | 0 | 0 | 5 | 28 | 107 | 160 | 206 | 236 | 255 |
| | 192 | 0 | 0 | 0 | 10 | 80 | 139 | 192 | 230 | 255 |
| | 224 | 0 | 0 | 0 | 5 | 24 | 112 | 176 | 224 | 255 |
| | 255 | 0 | 0 | 0 | 0 | 8 | 81 | 159 | 220 | 255 |

| | | GRAY SCALE OF SUBSEQUENT (CURRENT) FRAME | | | | | | | | |
|---|---|---|---|---|---|---|---|---|---|---|
| | | 0 | 32 | 64 | 96 | 128 | 160 | 192 | 224 | 255 |
| GRAY SCALE OF PREVIOUS FRAME | 0 | 0 | 71 | 92 | 121 | 149 | 181 | 208 | 239 | 255 |
| | 32 | 0 | 32 | 69 | 106 | 141 | 177 | 206 | 235 | 255 |
| | 64 | 0 | 25 | 64 | 103 | 139 | 176 | 205 | 235 | 255 |
| | 96 | 0 | 17 | 52 | 96 | 134 | 172 | 203 | 234 | 255 |
| | 128 | 0 | 13 | 40 | 93 | 128 | 168 | 201 | 233 | 255 |
| | 160 | 0 | 11 | 29 | 87 | 125 | 160 | 198 | 231 | 255 |
| | 192 | 0 | 9 | 20 | 80 | 118 | 154 | 192 | 227 | 255 |
| | 224 | 0 | 8 | 15 | 73 | 112 | 148 | 187 | 224 | 255 |
| | 255 | 0 | 8 | 12 | 69 | 106 | 142 | 183 | 223 | 255 |

DISPLAY PANEL DRIVING APPARATUS, DISPLAY PANEL DRIVING METHOD, DISPLAY APPARATUS, AND TELEVISION RECEIVER

TECHNICAL FIELD

The present invention relates to a technique for driving a display panel in view of a gray scale transition.

BACKGROUND ART

An overshoot (OS) driving can be exemplified as a technique for driving a display panel in view of a gray scale transition. A conventional OS driving uses an OS table (LUT) similar to one shown in FIG. 24.

For example, when an input gray scale is 0 gray scale in a frame (hereafter referred to as a previous frame) which is one frame before a current frame and an input gray scale of the current frame (hereafter referred to as a subsequent frame) is 224 gray scale (target gray scale), an OS gray scale of 239 gray scale is outputted in the subsequent frame (see FIG. 14). This allows a display panel to have response waveform (transmittance change) as illustrated in FIG. 15. Note that "OTn" in the graph denotes a transmittance corresponding to an nth gray scale. When an input gray scale of a previous frame is 64 gray scale and an input gray scale of a subsequent frame is 224 gray scale (target gray scale), an OS gray scale of 235 gray scale is outputted in the subsequent frame (see FIG. 16). This allows the display panel to have response waveform as illustrated in FIG. 17.

When FIG. 15 and FIG. 17 are compared, although ultimate transmittances at their ends of the subsequent frame are identical to each other, the respective response waveform in one frame are remarkably different from each other. Therefore, when (i) a display, in which 64 gray scale is changed into 224 gray scale in one frame, is carried out in an area X and (ii) a display, in which 0 gray scale is changed into 224 gray scale in one frame, is carried out in an area Y adjacent to the area X, the area Y has only reached at most near OT 90 (transmittance corresponding to 90 gray scale) at the moment when the area X reaches near OT 224 (transmittance corresponding to 224 gray scale). When the respective response waveform in one frame thus differ from each other remarkably, an unnatural transient state such as one shown in FIG. 18 is visualized as jaggy at an image edge (moving image edge) of a moving image.

When an input gray scale of a previous frame is 224 gray scale and an input gray scale of the subsequent frame is 32 gray scale (target gray scale), an OS gray scale of 0 gray scale is outputted in the subsequent frame (see FIG. 19). This allows the display panel to have response waveform (transmittance change) as illustrated in FIG. 20. When an input gray scale of a previous frame is 128 gray scale and an input gray scale of the subsequent frame is 32 gray scale (target gray scale), an OS gray scale of 0 gray scale is outputted in the subsequent frame (see FIG. 21). This allows the display panel to have response waveform as illustrated in FIG. 22.

When FIG. 20 and FIG. 22 are compared, although ultimate transmittances at their ends of the subsequent frame are identical to each other, the respective response waveform in one frame are remarkably different from each other. Therefore, when (i) a display, in which 224 gray scale is changed into 32 gray scale in one frame, is carried out in the area X and (ii) a display, in which 128 gray scale is changed into 32 gray scale in one frame, is carried out in the area Y adjacent to the area X, an unnatural transient state such as one shown in FIG. 23 is visualized as jaggy at an image edge (moving image edge) of the moving image.

Patent Document 1 discloses the following technique to improve a response speed of a liquid crystal display apparatus. Three consecutive frames are indicated as (n−2)th frame through nth frame. Based on gray scales of the (n−2)th frame and the nth frame, a gray scale of the middle (n−1)th frame is corrected. Specifically, as illustrated in FIG. 25, in a case where the input gray scales of the (n−2)th frame through the nth frame are a black gray scale, a black gray scale, and a white gray scale, respectively, the gray scale of the (n−1)th frame is corrected to have a gray scale slightly lighter than the black gray scale. Then, a maximum gray scale is provided in the nth frame, thereby quickening the response in the nth frame. Thus, the white gray scale display is improved.

[Patent Document 1]

Japan Unexamined Patent Publication, Tokukai, No. 2004-310113 (published Oct. 28, 2004)

DISCLOSURE OF INVENTION

However, even if the method thus disclosed in Patent Document 1 is applied, the response waveform becomes such as ones illustrated in FIGS. 15 and 17 when a moving image display as like one shown in FIG. 18 is carried out. This causes jaggy at an edge of the moving image.

The present invention is made in view of the problems, and its object is to provide a display panel driving apparatus capable of improving moving image display quality of a display panel.

A display panel driving apparatus in accordance with the present invention is a display panel driving apparatus which generates gray scales corresponding to first through nth sub-frames into which one frame is divided, and drives a display panel based on the gray scales thus generated, wherein, in a rising response in which a gray scale of a previous frame is Tf and a gray scale of a subsequent frame is Tr, T1 and T2 satisfy inequalities: (i) $T1 \geqq Tf$, (ii) $T2 \geqq Tr$, and (iii) $T1-Tf<T2-T1$, where T1 is a gray scale generated so as to correspond to a first sub-frame of the subsequent frame, and T2 is a gray scale generated so as to correspond to any one of a second to nth sub-frames of the subsequent frame.

The arrangement causes (i) an intermediate state, which is not much different to an end state of the previous frame, to be formed in a first sub-frame and (ii) a transition to be carried out to an end state of the subsequent frame from this intermediate state. With the arrangement, it is possible to make similar to each other both of response waveform in one frame on a display panel side to a degree, regardless of gray scale transition of the previous and subsequent frames (combination of Tf and Tr). This allows a reduction in jaggy at an edge of the moving image. As a result, it is possible to ultimately improve moving image display quality in a display panel. In the arrangement, the T2 may be generated as the gray scale of the second sub-frame.

With the arrangement, it is preferable such that when the Tf is in a low gray scale range, T1 increases as the Tr increases, whereas, when the Tf is in an intermediate gray scale range or a high gray scale range, $T1=Tf$ is satisfied, regardless of Tr.

In the arrangement, when Tf is in a low gray scale range (particularly near 0 gray scale) in which it becomes difficult to carry out a rising response, T1 is also increased as the gray scale Tr of the subsequent frame increases. This allows a tilt gray scale required in the first sub-frame to be provided in advance, thereby increasing the response speed of the second sub-frame. On the other hand, when Tf is in an intermediate gray scale range or in a high gray scale range, a rising response is easily performed. Therefore, the gray scale is set to satisfy T1=Tf, regardless of Tr. This makes the intermediate state equal to the end state of the previous frame. As a result, the respective response waveform are made similar to each other in one frame. This allows a further reduction in jaggy at an edge of the moving image.

In the arrangement, it is preferable that $T1-Tf<(Tr-Tf)\times 0.1$ is further satisfied. By providing a small tilt gray scale in the first sub-frame (less than 10% of a gray scale transition amount), it is possible to increase the response speed of the second sub-frame while the end state of the first sub-frame (intermediate state) is made substantially equal to the end state of the previous frame. This causes the respective response waveform to be made similar to each other, which further reduces the jaggy at the edge of the moving image.

The display panel driving apparatus of the present invention generates gray scales corresponding to first through nth sub-frames into which one frame is divided, and drives a display panel by use of the gray scales thus generated, wherein, in a decay response in which a gray scale of a previous frame is Tf and a gray scale of a subsequent frame is Tr, T1 and T2 satisfy inequalities: (i) $T1\leqq Tf$, (ii) $T2\leqq Tr$, and (iii) $Tf-T1<T1-T2$, where T1 is a gray scale generated so as to correspond to a first sub-frame of the subsequent frame, and T2 is a gray scale generated so as to correspond to any one of a second through nth sub-frames of the subsequent frame.

The arrangement causes (i) an intermediate state, which is not much different to an end state of the previous frame, to be formed in a first sub-frame and (ii) a transition to be carried out to an end state of the subsequent frame from this intermediate state. With the arrangement, it is possible to make similar to each other both of response waveform in one frame on a display panel side to a degree, regardless of gray scale transition of the previous and subsequent frames (combination of Tf and Tr). This allows a reduction in jaggy at an edge of the moving image. As a result, it is possible to ultimately improve moving image display quality in a display panel. In the arrangement, the T2 may be generated as the gray scale of the second sub-frame.

In the arrangement, it is preferable that $Tf-T1<(Tf-Tr)\times 0.1$ is further satisfied. By providing a small tilt gray scale at the first sub-frame (less than 10% of a gray scale transition amount), it is possible to increase the response speed of the second sub-frame while the end state of the first sub-frame (intermediate state) is made substantially equal to the end state of the previous frame. This causes the respective response waveform to be made similar to each other, which further reduces the jaggy at the edge of the moving image.

The display panel driving apparatus of the present invention may be arranged such that the display panel is of a VA type liquid crystal panel.

A method of the present invention for driving a display panel is a method including: generating gray scales corresponding to a first through nth sub-frames into which one frame is divided; and driving a display panel by use of the gray scales thus generated, wherein, in a rising response in which a gray scale of a previous frame is Tf and a gray scale of a subsequent frame is Tr, T1 and T2 satisfy inequalities: (i) $T1\geqq Tf$, (ii) $T2\geqq Tr$, and (iii) $T1-Tf<T2-T1$, where T1 is a gray scale generated so as to correspond to a first sub-frame of the subsequent frame, and T2 is a gray scale generated so as to correspond to any one of a second through nth sub-frame of the subsequent frame.

A method of the present invention for driving a display panel is a method including: generating gray scales corresponding to a first through nth sub-frame into which one frame is divided; and driving a display panel by use of the gray scales thus generated, wherein, in a decay response in which a gray scale of a previous frame is Tf and a gray scale of a subsequent frame is Tr, T1 and T2 satisfy inequalities: (i) $0\leqq Tf$, (ii) $T2\leqq Tr$, and (iii) $Tf-T1<T1-T2$, where T1 is a gray scale generated so as to correspond to a first sub-frame of the subsequent frame, and T2 is a gray scale generated so as to correspond to any one of a second through nth sub-frames of the subsequent frame.

A display apparatus of the present invention (for example, a liquid crystal display apparatus) includes a display panel and a display panel driving apparatus.

A television receiver of the present invention includes the display apparatus and a tuner section for receiving television broadcast.

As described above, a display panel driving apparatus of the present invention causes (i) an intermediate state, which is not much different to an end state of the previous frame, to be formed in the first sub-frame and (ii) a transition to be carried out to an end state of the subsequent frame from this intermediate state. With the arrangement, it is possible to make similar to each other both of response waveform in one frame on a display panel side to a degree, regardless of gray scale transition of the previous and subsequent frames (combination of Tf and Tr). This allows a reduction in jaggy at an edge of the moving image. As a result, it is possible to ultimately improve moving image display quality on a display panel.

BRIEF DESCRIPTION OF DRAWINGS

FIG. 6 is a table showing a first sub-frame data LUT in accordance with the present embodiment.

FIG. 7 is a table showing a second sub-frame data LUT in accordance with the present embodiment.

REFERENCE NUMERALS

Figure 1:
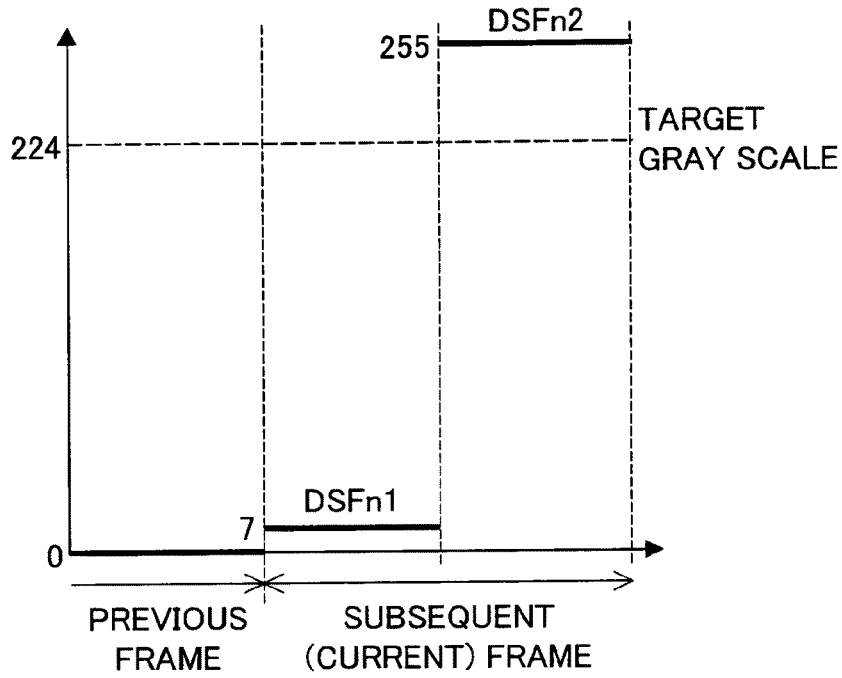
FIG. 1 is a graph illustrating gray scales of each sub-frame in a rising response of 0 to 224 gray scale in the present embodiment.

3 Source driver
6 Memory
9 Signal processing section
10 Liquid crystal panel
18 First sub-frame data LUT
19 Second sub-frame data LUT
20 Liquid crystal display apparatus
22 Sub-frame data generation section (liquid crystal panel driving apparatus)
25 Sub-frame data selecting section
30 Previous frame memory
40 Subsequent frame memory
DF Frame data
DF (n-1) Previous frame data
DFn Subsequent frame data (present frame data)
DSFn1 First sub-frame data
DSFn2 Second sub-frame data

BEST MODE FOR CARRYING OUT THE INVENTION

One embodiment of the present invention is described below with reference to FIGS. 1 through 13, and FIG. 26. FIG. 5 is a block diagram illustrating an arrangement of a liquid crystal display apparatus of the present embodiment. As illustrated in FIG. 5, a liquid crystal display apparatus 20 of the present embodiment includes a VA type liquid crystal panel 10, and a liquid crystal panel driving apparatus (not illustrated). The liquid crystal panel driving apparatus includes a signal processing section 9 and a source driver 3. Note that the liquid crystal panel 10 and the source driver 3 may be integral with each other. A gamma of the liquid crystal panel is set to 2.2.

The signal processing section 9 includes a memory (memory section) 6, a sub-frame data generation section 22, a sub-frame data selecting section 25, and a field counter section 35. The memory 6 includes a first sub-frame data LUT 18, a second sub-frame data LUT 19, a frame memory 30 of a previous frame, and a frame memory 40 of a subsequent frame.

The signal processing section 9 receives a frame data (input gray scale) DF at a frequency of 60 [Hz]. In the previous frame memory 30, frame data DF(n-1) of a previous frame is stored by an amount corresponding to one frame. In the subsequent frame memory 40, frame data DFn of the subsequent frame (current frame) is stored by an amount corresponding to one frame.

The sub-frame data generation section 22 reads out, from the respective frame memories (30 and 40) at a double-speed (120 Hz), the frame data DF(n-1) of the previous frame and the frame data DFn of the subsequent frame, respectively. Thereafter, the sub-frame data generation section 22 generates (i) first sub-frame data DSFn1 with reference to the first sub-frame data LUT 18 and (ii) second sub-frame data DSFn2 with reference to the second sub-frame data LUT 19.

The first sub-frame data DSFn1 and the second sub-frame data DSFn2 are supplied to the sub-frame data selecting section 25. The data DSFn1 and DSFn2 are alternately outputted by the sub-frame data selecting section 25 at a frequency of 120 [Hz]. The field counter section 35 watches output of the subsequent frame memory 40 so as to determine whether it is a timing of the first sub-frame display or the second sub-frame display, and then supplies a determination result to the sub-frame data selecting section 25.

The sub-frame selecting section 25 supplies, based on the determination result of the field counter 35, (i) the first sub-frame data DSFn1 at a start timing of the first sub-frame to the source driver 3 and (ii) the second sub-frame data DSFn2 at a start timing of the second sub-frame to the source driver 3.

The source driver 3 converts each of the sub-frame data (DSFn1 and DSFn2) to an analog electric potential signal, and drives each source lines (data signal lines) of the liquid crystal panel 10 in accordance with the potential signal thus converted.

The following description deals with a specific example in which the first and second sub-frame data (DSFn1 and DSFn2) are generated by the sub-frame data generation section 22. FIG. 6 is an example of the first sub-frame data LUT 18. FIG. 7 is an example of the second sub-frame data LUT 19. As shown in FIG. 6, in the first sub-frame data LUT 18, the first sub-frame data DSFn1 (the first sub-frame data DSFn1 of the subsequent frame) (generated gray scale T1), which corresponds to a combination of (i) frame data DF(n-1) of a previous frame (input gray scale Tf) and (ii) frame data DFn of the subsequent frame (input gray scale Tr), is stored. As shown in FIG. 7, in the second sub-frame data LUT 19, the second sub-frame data DSFn2 (the second sub-frame data DSFn2 of the subsequent frame) (generated gray scale T2), which corresponds to a combination of frame data DF(n-1) of a previous frame (input gray scale Tf) and frame data DFn of the subsequent frame (input gray scale Tr), are stored. As to a combination other than the ones shown in the tables of FIG. 6 and FIG. 7, a sub-frame data DSFn1 and DSFn2 can be found with the use of a linear interpolation, for example.

As illustrated in FIGS. 6 and 7, in a rising response in which a gray scale of the subsequent frame is greater than a gray scale of the previous frame (Tf<Tr), inequalities (i) T1≧Tf, (ii) T2≧Tr, (iii) T1−Tf<T2−T1, and (iv) T1−Tf<(Tr−Tf)×0.1 are satisfied. In addition, when Tf is in a low gray scale range (0 gray scale to 64 gray scale), T1 increases as Tr increases. On the other hand, when Tf is in a medium gray scale range or a high gray scale range (64 gray scale to 255 gray scale), T1=Tf is satisfied, regardless of Tr.

For example, when an input gray scale Tf of the previous frame is 0 gray scale and an input gray scale Tr of the subsequent frame is 224 gray scale, 7 gray scale is generated as the gray scale of the first sub-frame, and 255 gray scale is generated as the gray scale of the second sub-frame. When an input gray scale Tf of the previous frame is 64 gray scale and an input gray scale Tr of the subsequent frame is 224 gray scale, 68 gray scale is generated as the gray scale of the first sub-frame, and 248 gray scale is generated as the gray scale of the second sub-frame. When an input gray scale Tf of the previous frame is 0 gray scale and an input gray scale Tr of the subsequent frame is 255 gray scale, 8 gray scale is generated as the gray scale of the first sub-frame, and 255 gray scale is generated as the gray scale of the second sub-frame.

On the other hand, as illustrated in FIGS. 6 and 7, in a decay response in which a gray scale of the subsequent frame is less than the previous frame (TF>Tr), inequalities (i) T1≦Tf, (ii) T2≦Tr, (iii) Tf−T1<T1−T2, and (iv) Tf−T1<(Tf−Tr)×0.1 are satisfied.

For example, when an input gray scale of the previous frame is 224 gray scale and an input gray scale of the subsequent frame is 32 gray scale, 222 gray scale is generated as the gray scale of the first sub-frame, and 0 gray scale is generated as the gray scale of the second sub-frame. When an input gray scale of the previous frame is 128 gray scale and an input gray scale of the subsequent frame is 32 gray scale, 128 gray scale is generated as the gray scale of the first sub-frame, and 4 gray scale is generated as the gray scale of the second sub-frame. When an input gray scale of the previous frame is 255 gray scale and an input gray scale of the subsequent frame is 0 gray scale, 248 gray scale is generated as the gray scale of the first sub-frame, and 0 gray scale is generated as the gray scale of the second sub-frame.

In a response in which hardly any or no gray scale transitions occur between a previous frame and the subsequent frame, a gray scale of the subsequent frame is generated as the gray scale of the first sub-frame and also as the gray scale of the second sub-frame.

A signal processing section in accordance with the present embodiment includes first and second sub-frame data LUTs. Therefore, it is possible to improve the moving image display quality of a liquid crystal panel as follows.

Figure 8:
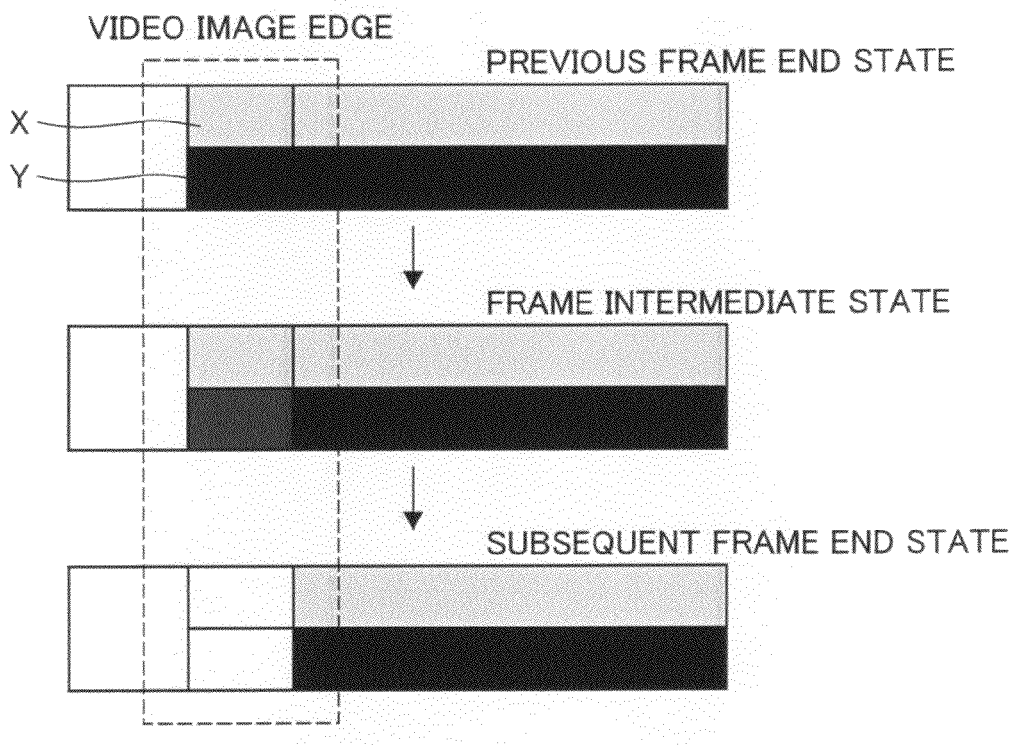
FIG. 8 is an explanatory drawing schematically illustrating an effect (reduction of jaggy at an edge of a moving image in a rising response) of the present embodiment.
Figure 9:
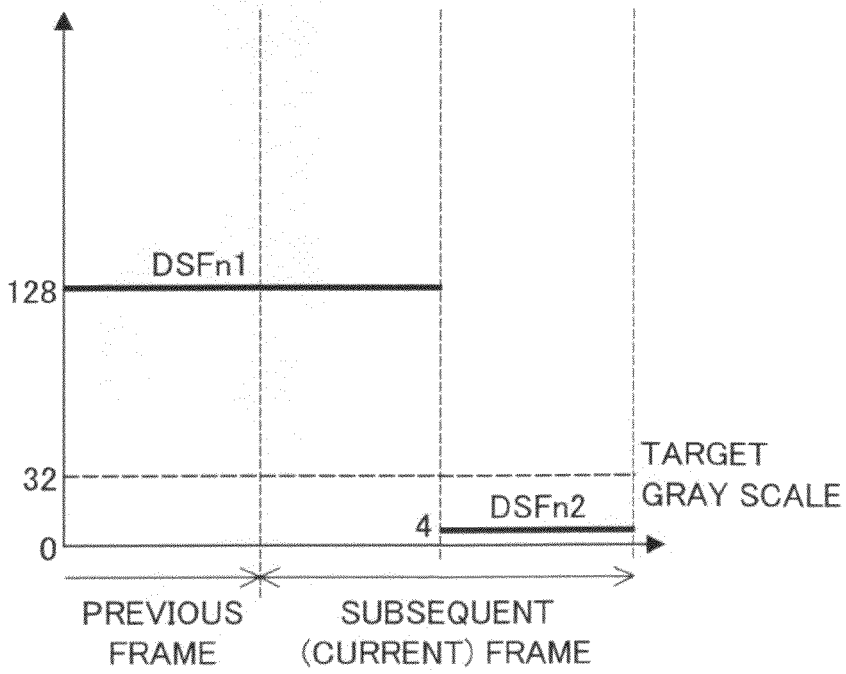
FIG. 9 is a graph illustrating gray scales of each sub-frame in a decay response of 128 to 32 gray scale in the present embodiment.

More specifically, when a display as shown in FIG. 8 is carried out, namely, when (i) a display, in which 64 gray scale is changed into 224 gray scale in one frame, is carried out in an area X and (ii) a display, in which 0 gray scale is changed into 224 gray scale in one frame, is carried out in an area Y adjacent to the area X, 68 gray scale and 248 gray scale are outputted, in the area X, as the first sub-frame and the second sub-frame, respectively (see FIG. 3), and 7 gray scale and 255 gray scale are outputted, in the area Y, as the gray scale of the first sub-frame and the second sub-frame, respectively (see FIG. 1).

Figure 2:
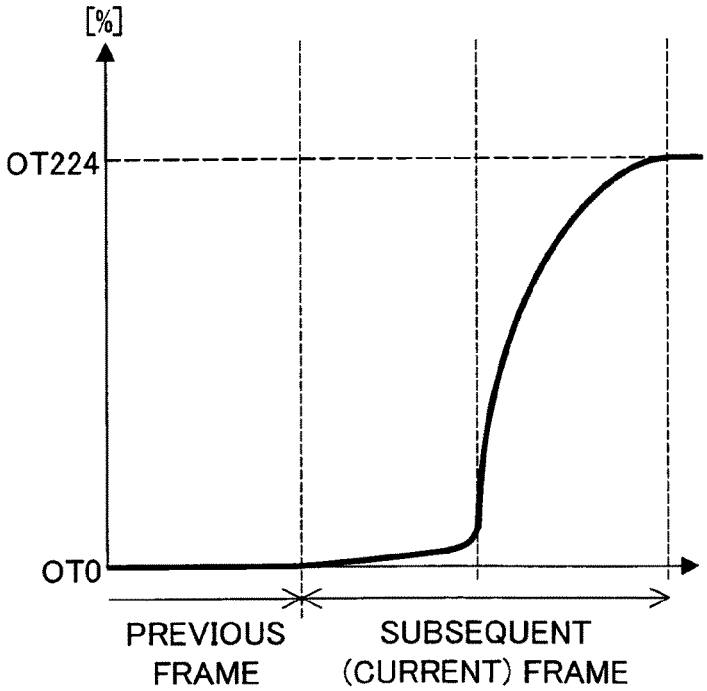
FIG. 2 is a graph illustrating a response waveform (transmittance change) in which a liquid crystal panel has in a rising response of 0 to 224 gray scale in the present embodiment.
Figure 3:
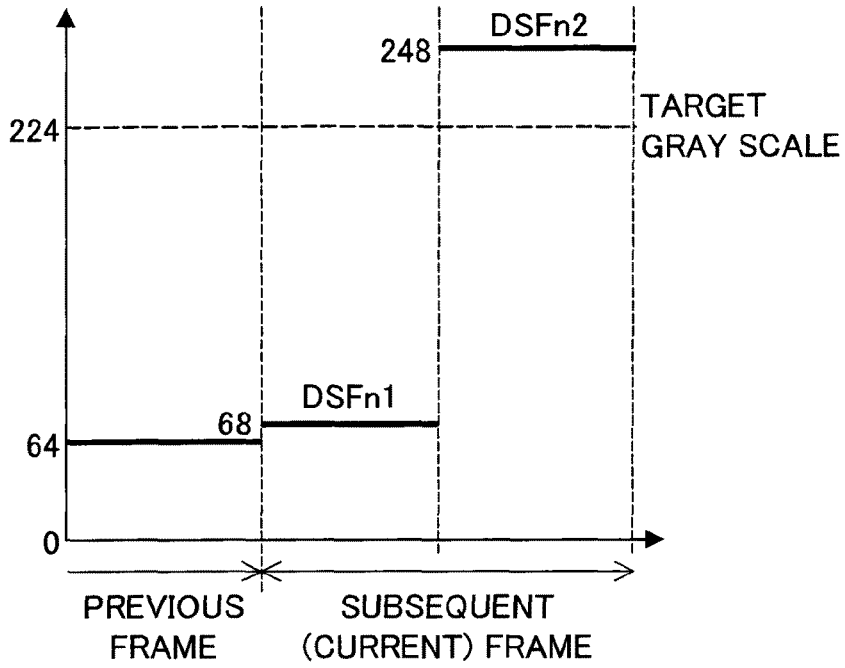
FIG. 3 is a graph illustrating gray scales of each sub-frame in a rising response of 64 to 224 gray scale in the present embodiment.
Figure 4:
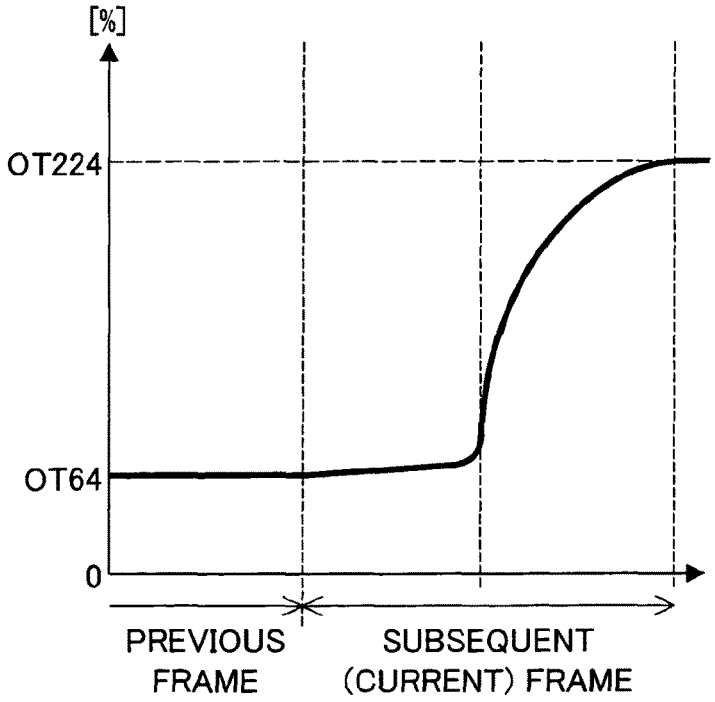
FIG. 4 is a graph illustrating a response waveform (transmittance change) in which a liquid crystal panel has in a rising response of 64 to 224 gray scale in the present embodiment.
Figure 5:
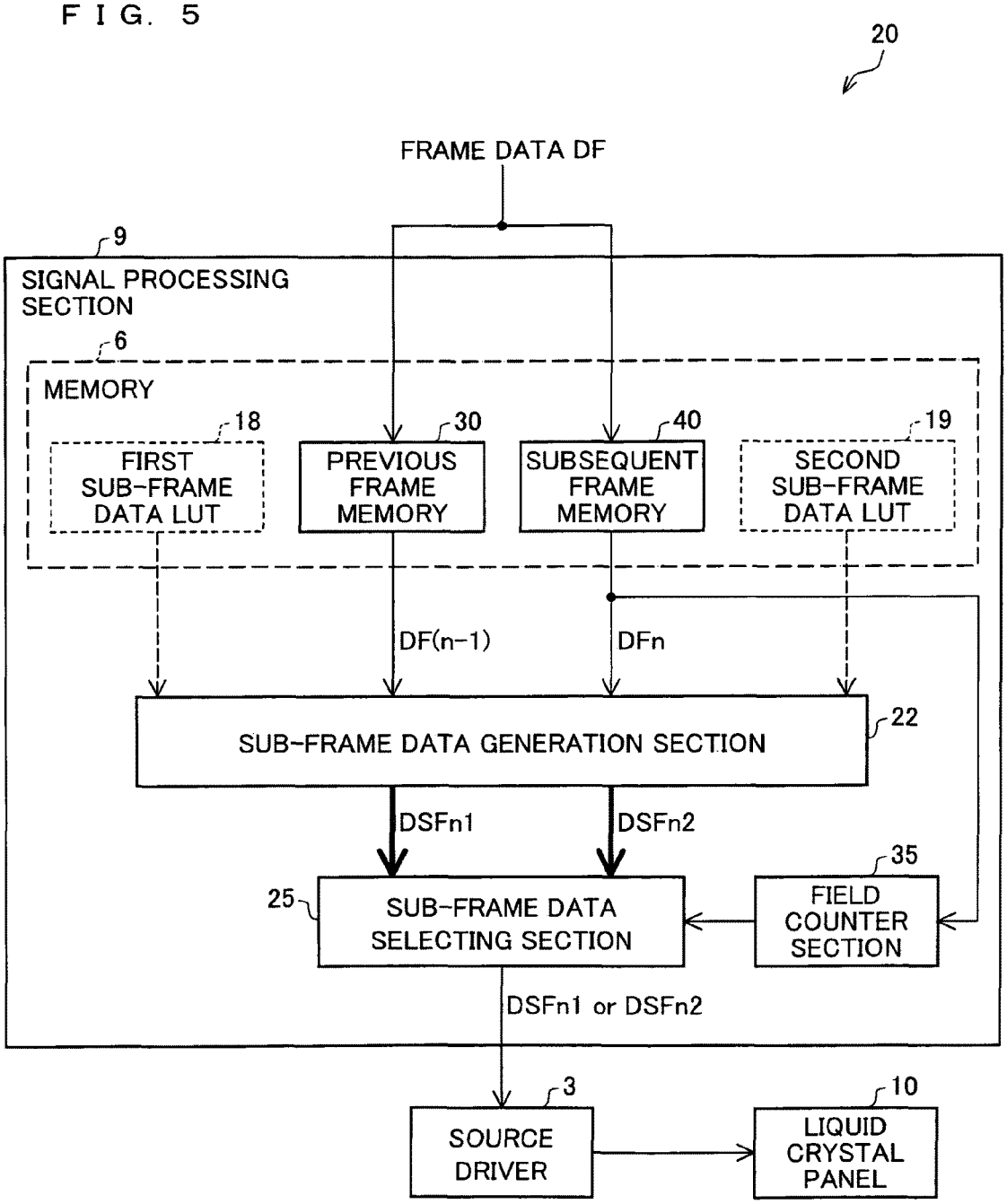
FIG. 5 is a block diagram illustrating an arrangement of a liquid crystal display apparatus in accordance with the present embodiment.

As a result, the liquid crystal panel has the response waveform (transmittance change) as shown in FIG. 4 in the area X, and has the response waveform as shown in FIG. 2 in the area Y. Thus, it is possible to make both waveform similar to each other. Note that "OTn" in the drawings denotes a transmittance [%] corresponding to an nth gray scale. In a response in the area Y, 7 gray scale (tilt gray scale) is provided in the first sub-frame, and 255 gray scale (overshoot gray scale), which is not less than the gray scale of the subsequent frame, is provided in the second sub-frame. As such, a response speed of the second sub-frame is improved. That is, with the present embodiment, an intermediate state, which is not much different to an end state of the previous frame, is formed at a middle point of one frame in each of the area X and the area Y. As such, it is possible to carry out a transition to an end state of the subsequent frame from the intermediate state at once (at a high speed).

Figure 18:
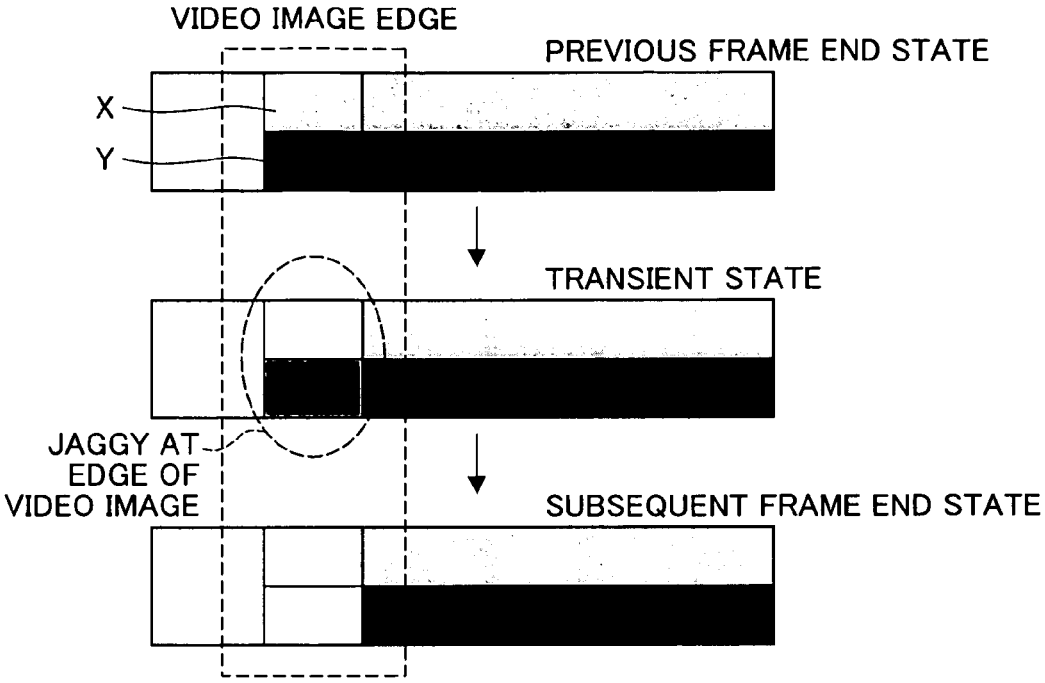
FIG. 18 CONVENTIONAL ART
FIG. 18 is an explanatory drawing schematically illustrating a conventional problem such that jaggy occurs at an edge of a moving image (in a rising response).
Figure 19:
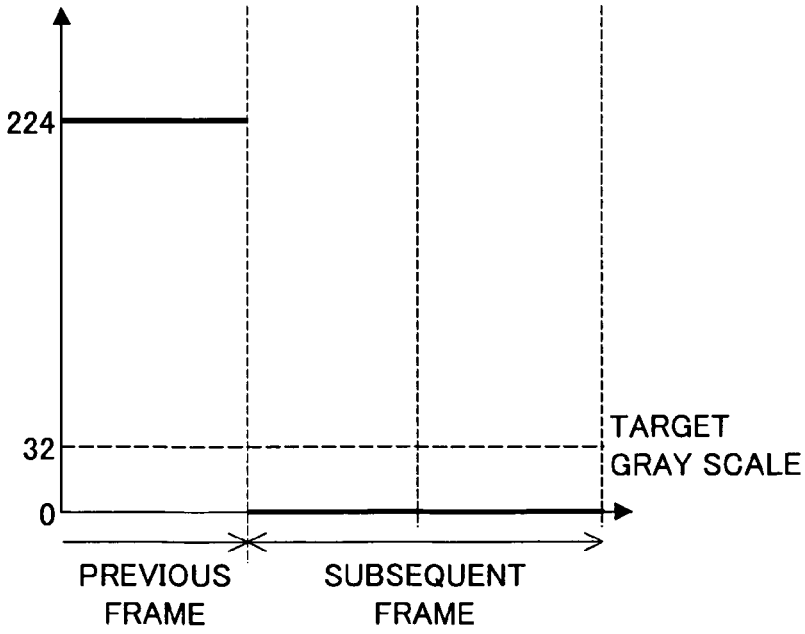
FIG. 19 CONVENTIONAL ART
FIG. 19 is a graph illustrating an output gray scale in a decay response of 224 to 0 gray scale in a conventional OS driving.
Figure 20:
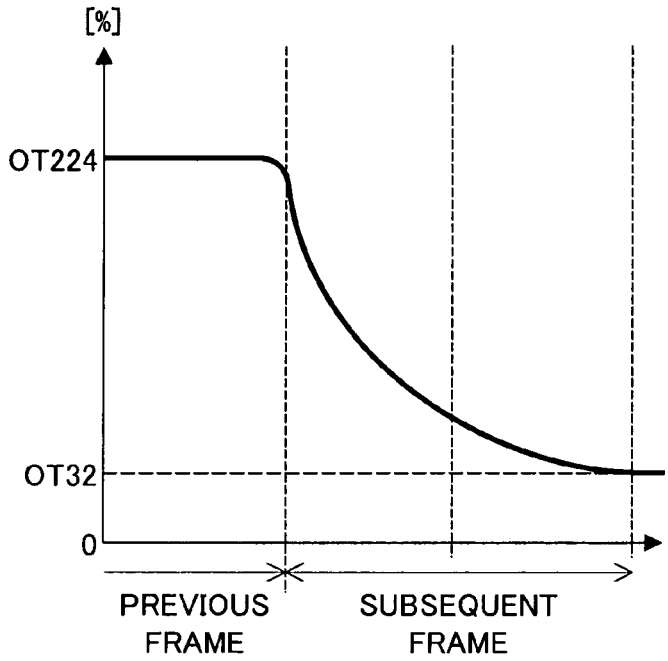
FIG. 20 CONVENTIONAL ART
FIG. 20 is a graph illustrating a response waveform (transmittance change) in which a liquid crystal panel has in a decay response of 224 to 0 gray scale in a conventional OS driving.
Figure 21:
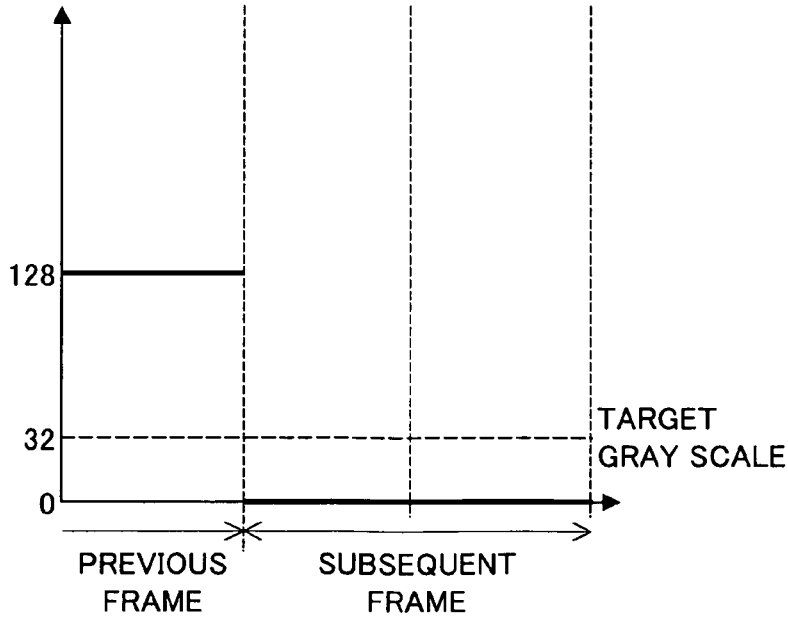
FIG. 21 CONVENTIONAL ART
FIG. 21 is a graph illustrating an output gray scale in a decay response of 224 to 64 gray scale in a conventional OS driving.
Figure 22:
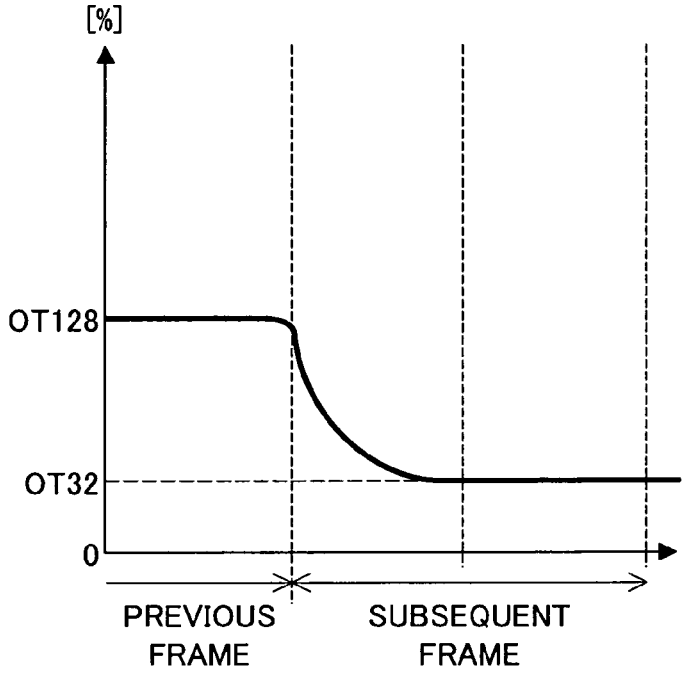
F I G. 2 2 CONVENTIONAL ART
FIG. 22 is a graph illustrating a response waveform (transmittance change) in which a liquid crystal panel has in a decay response of 224 to 64 gray scale in a conventional OS driving.

As described above, since the waveform in the area X is made similar to the waveform in the area Y during one frame in a rising response, the unnatural transient state as illustrated in FIG. 18 does not occur, thereby allowing a great reduction in jaggy at an edge of a moving image.

Figure 11:
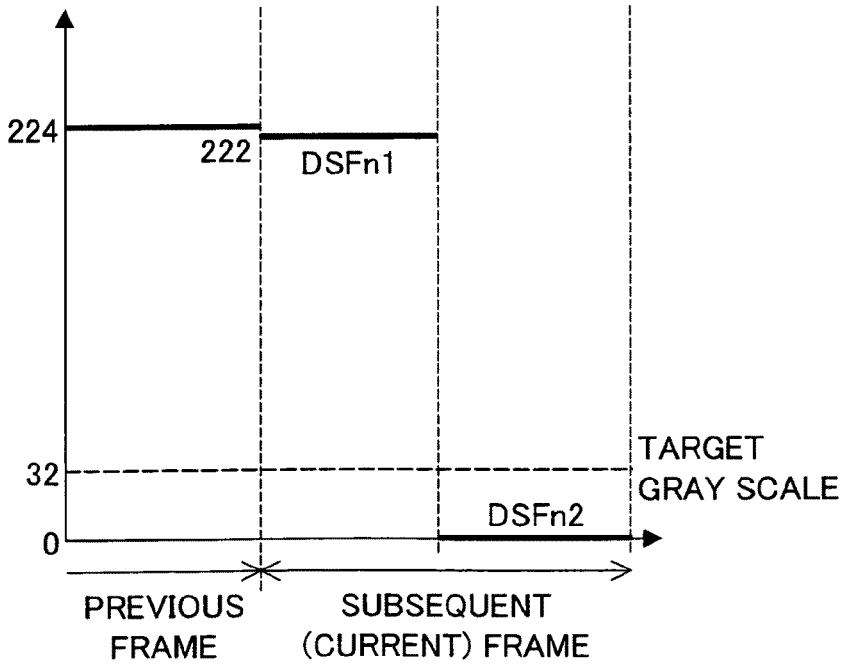
FIG. 11 is a graph illustrating gray scales of each sub-frame in a decay response of 224 to 32 gray scale in the present embodiment.
Figure 13:
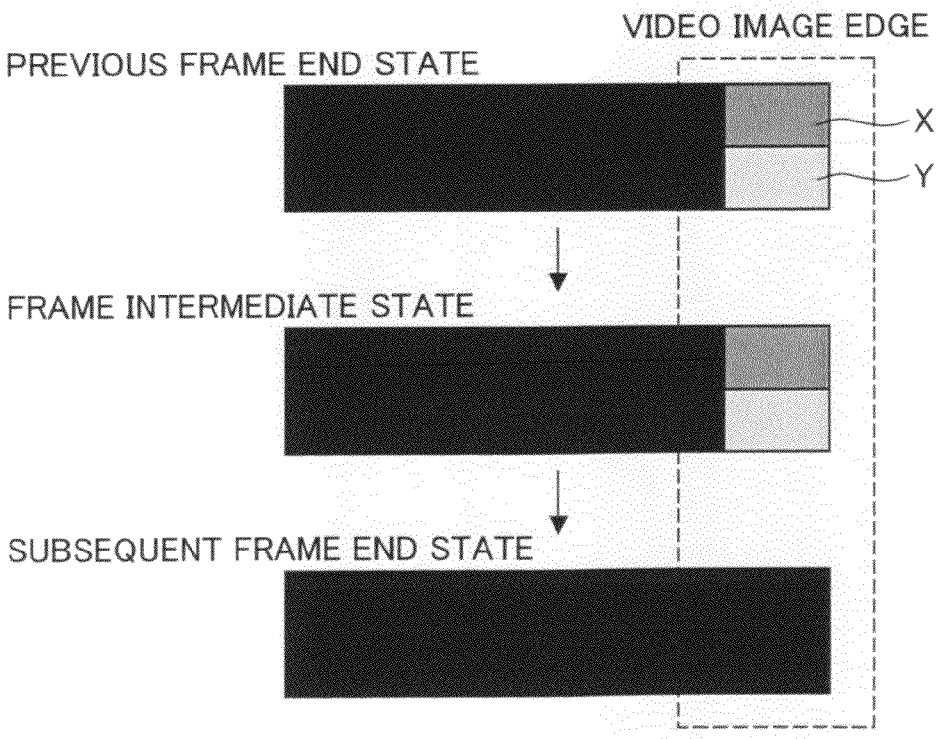
FIG. 13 is an explanatory drawing schematically illustrating an effect (reduction of jaggy at an edge of a moving image in a decay response) of the present embodiment.
Figure 14:
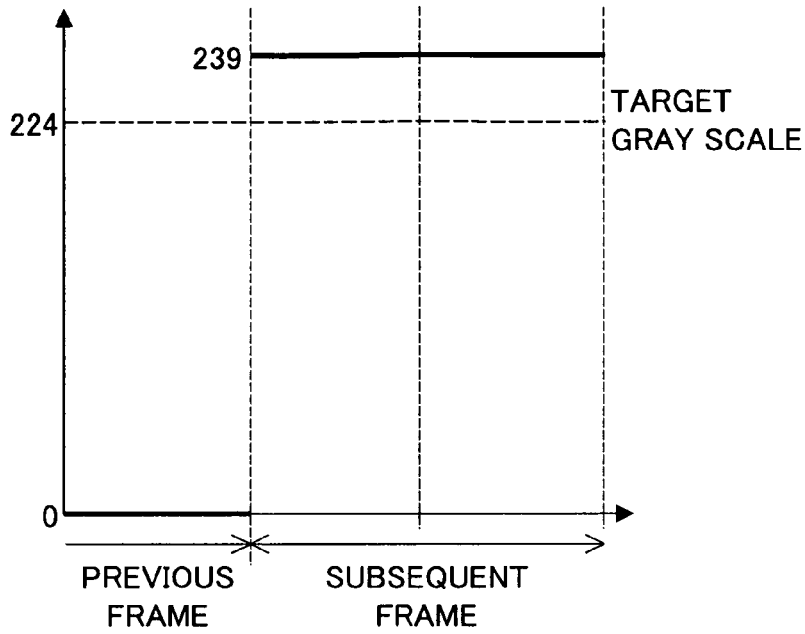
FIG. 14 CONVENTIONAL ART
FIG. 14 is a graph illustrating an output gray scale in a rising response of 0 to 224 gray scale in a conventional OS driving.
Figure 15:
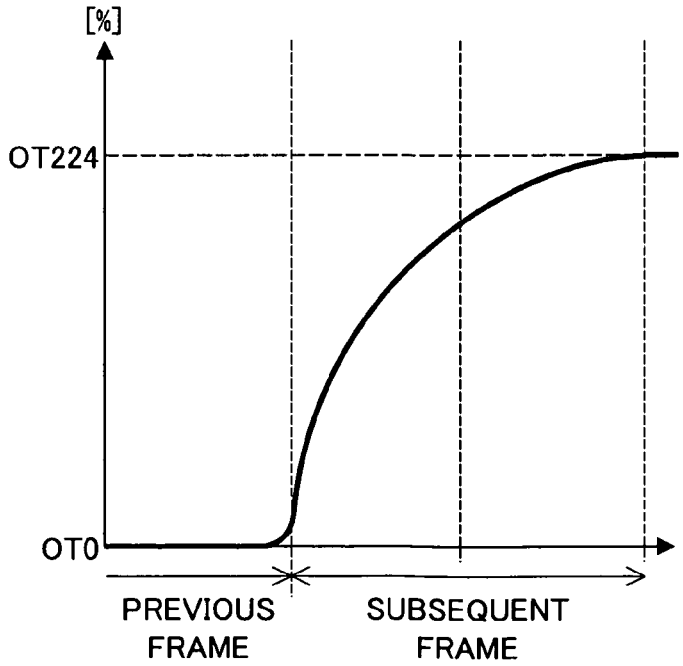
FIG. 15 CONVENTIONAL ART
FIG. 15 is a graph illustrating a response waveform (transmittance change) in which a liquid crystal panel has in a rising response of 0 to 224 gray scale in a conventional OS driving.
Figure 16:
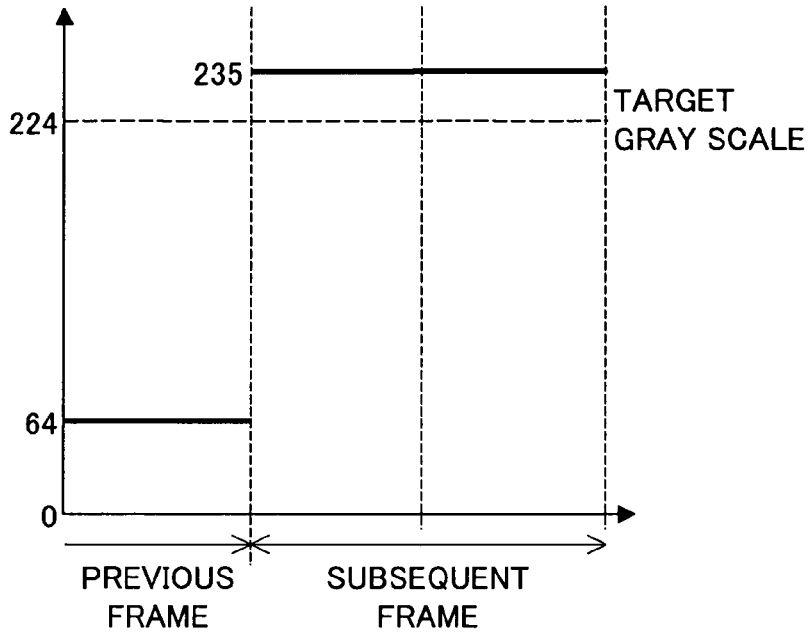
F I G. 1 6 CONVENTIONAL ART
FIG. 16 is a graph illustrating an output gray scale in a rising response of 64 to 224 gray scale in a conventional OS driving.
Figure 17:
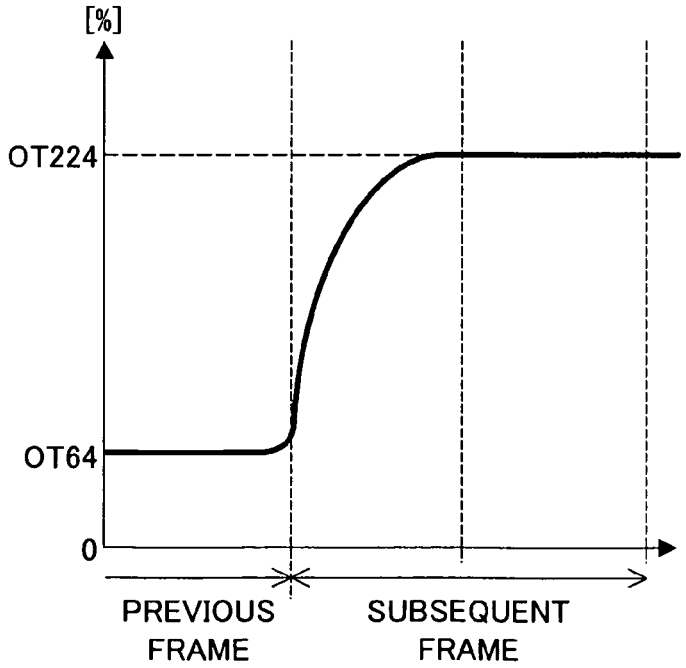
F I G. 1 7 CONVENTIONAL ART
FIG. 17 is a graph illustrating a response waveform (transmittance change) in which a liquid crystal panel has in a rising response of 64 to 224 gray scale in a conventional OS driving.

As shown in FIG. 13, when (i) a display, in which a gray scale is changed from 128 gray scale to 32 gray scale in one frame, is carried out in the area X and (ii) a display, in which a gray scale is changed from 224 gray scale to 32 gray scale in one frame, is carried out in the area Y adjacent to the area X, 128 gray scale and 4 gray scale are outputted in the area X as the first sub-frame and the second sub-frame, respectively (see FIG. 9), and 222 gray scale and 0 gray scale are outputted in the area Y as the gray scale of the first sub-frame and the second sub-frame, respectively (see FIG. 11).

Figure 10:
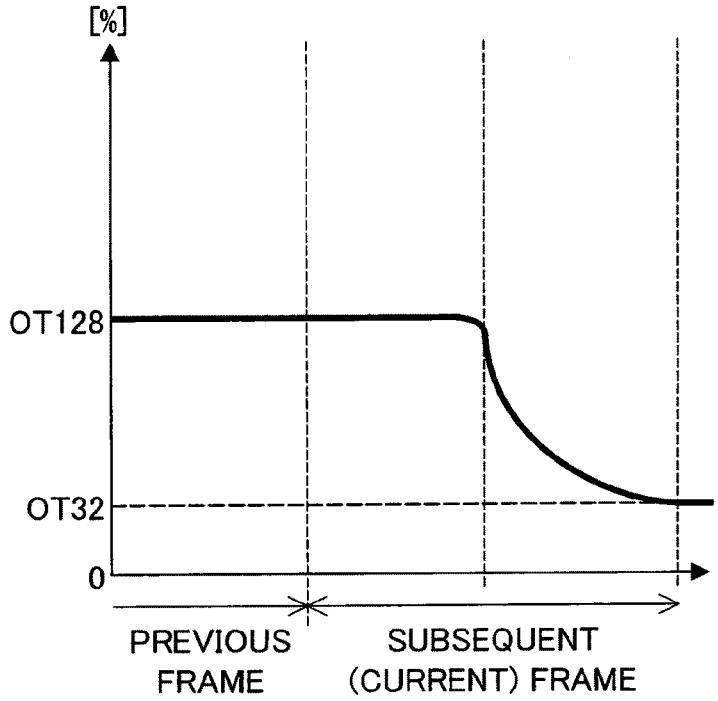
FIG. 10 is a graph illustrating a response waveform (transmittance change) in which a liquid crystal panel has in a decay response of 128 to 32 gray scale in the present embodiment.
Figure 12:
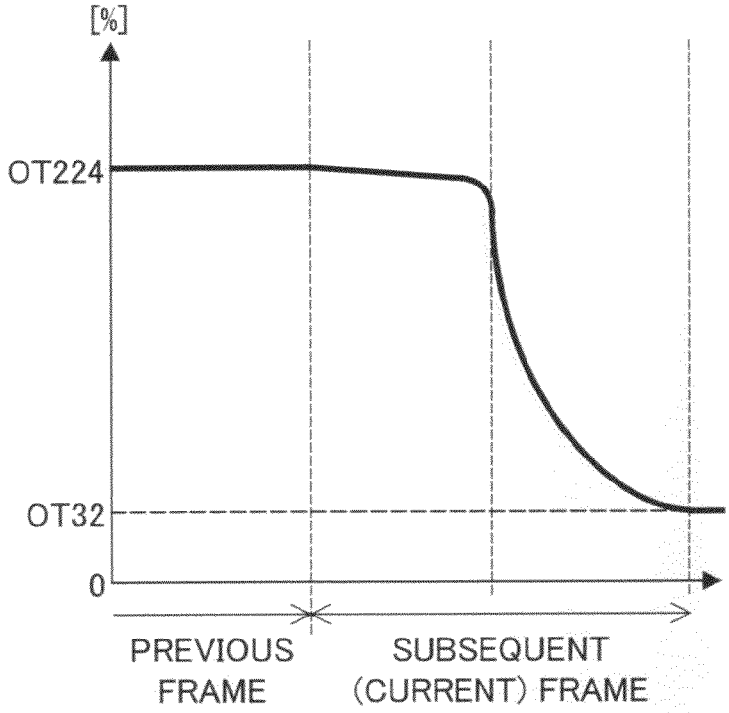
FIG. 12 is a graph illustrating a response waveform (transmittance change) in which a liquid crystal panel has in a decay response of 224 to 32 gray scale in the present embodiment.

As a result, the liquid crystal panel has the response waveform (transmittance change) as shown in FIG. 10 in the area X, and has the response waveform as shown in FIG. 12 in the area Y. Thus, it is possible to make both of the waveform similar to each other. In a response in the area Y, 222 gray scale (tilt gray scale) is provided in the first sub-frame, and 0 gray scale (overshoot gray scale), which is less than a gray scale of the subsequent frame, is provided in the second sub-frame. As such, a response speed of the second sub-frame is improved. That is, with the present embodiment, an intermediate state, which is not much different to an end state of the previous frame, is formed at a middle point of one frame in each of the area X and the area Y. As such, it is possible to carry out a transition to an end state of the subsequent frame from the intermediate state at once (at a high speed).

Figure 23:
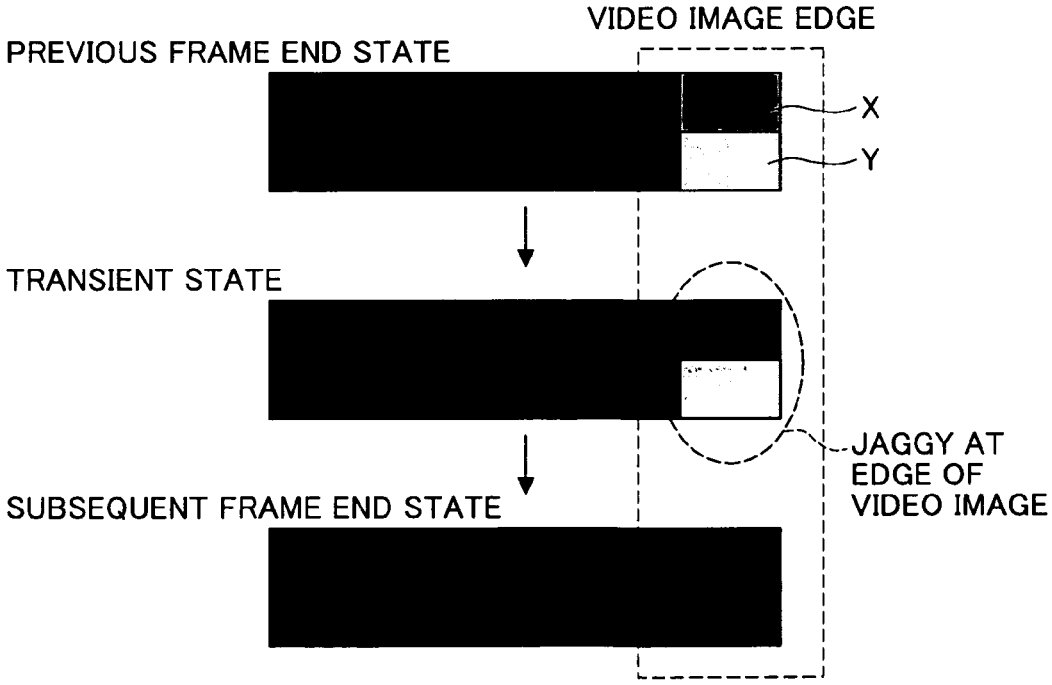
F I G. 2 3 CONVENTIONAL ART
FIG. 23 is an explanatory drawing schematically illustrating a conventional problem such that jaggy occurs at an edge of a moving image (in a decay response).
Figures 24, 25:
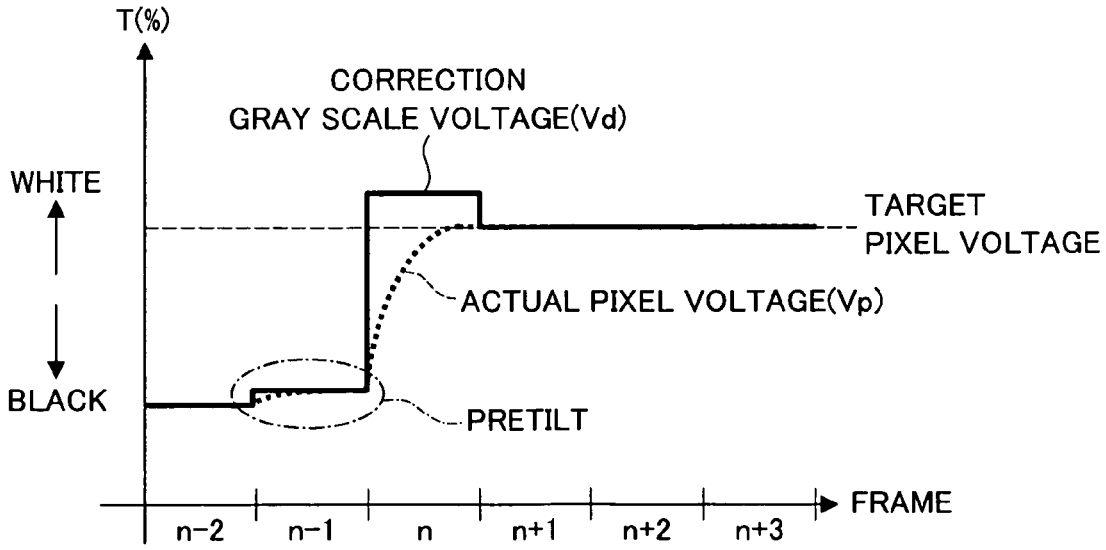
FIG. 24 CONVENTIONAL ART
FIG. 25 CONVENTIONAL ART
FIG. 24 is a table showing an LUT used in a conventional OS driving.
FIG. 25 is a graph illustrating a response waveform (transmittance change) in which a liquid crystal panel has in a conventional OS driving.

As described above, since the waveform in the area X is made similar to the waveform in the area Y during one frame in a decay response, the unnatural transient state as illustrated in FIG. 23 does not occur, thereby allowing a great reduction in jaggy at an edge of a moving image.

Functions of the sections in the signal processing section 9 in FIG. 5 (such as the sub-frame data generation section 22 and the sub-frame data selecting section 25) are realizable, for example, by an ASIC or a CPU.

Figure 26:
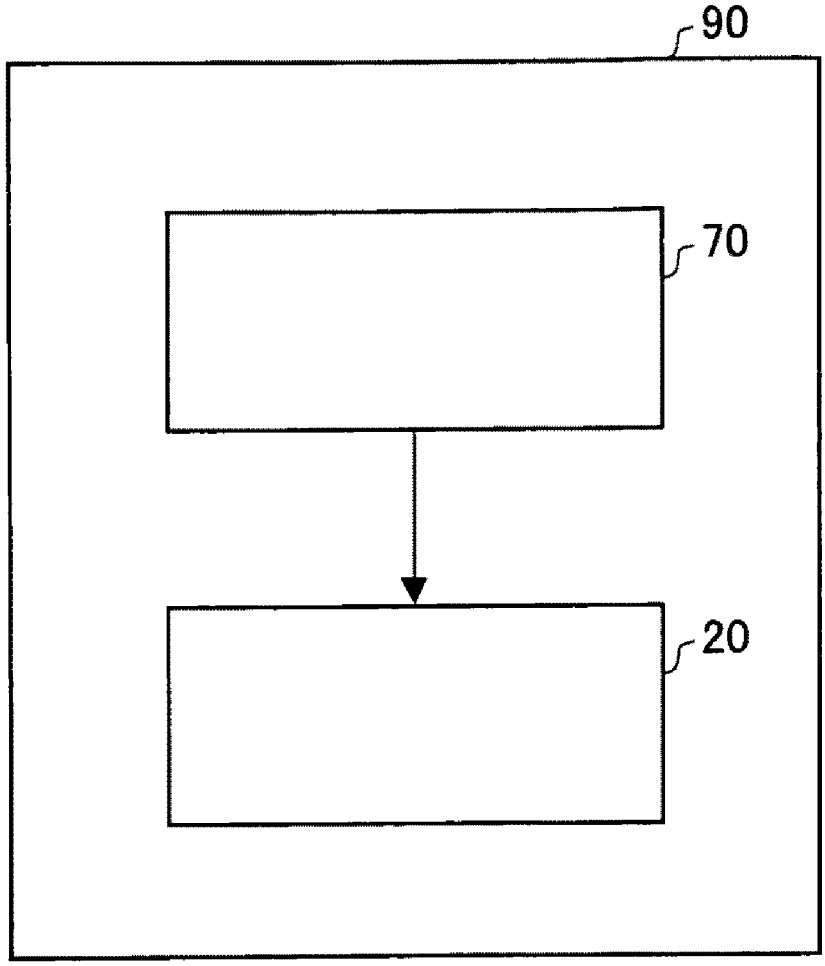
FIG. 26 is a block diagram illustrating an arrangement of a television receiver in accordance with the present embodiment.

A television receiver (liquid crystal television) of the present embodiment includes a liquid crystal display apparatus 20 of the present embodiment and a tuner section 70, as illustrated in FIG. 26. The tuner section 70 receives television broadcast, and outputs video signals. Namely, in the television receiver 90, the liquid crystal display apparatus 20 performs video (image) display based on the video signals outputted from the tuner section 70.

INDUSTRIAL APPLICABILITY

A liquid crystal panel driving apparatus of the present invention and a display apparatus including the liquid crystal panel driving apparatus are suitable for a liquid crystal television, for example.

The invention claimed is:

1. A display apparatus including a signal processing section which generates gray scales corresponding to first through nth sub-frames into which one frame is divided, wherein, in a rising response in which a gray scale of a previous frame is Tf and a gray scale of a subsequent frame is Tr, the signal processing section is configured to generate T1, which is a gray scale corresponding to a first sub-frame of the subsequent frame, and T2, which is a gray scale corresponding to any one of a second through nth sub-frames of the subsequent frame, said T1 and T2 satisfying inequalities: (i) $T1 \geqq Tf$, (ii) $T2 \geqq Tr$, and (iii) $T1-Tf<T2-T1$, and if said Tf is included in a first gray scale range, said T1 increases as said Tr increases, and if said Tf is included in a second gray scale range, $T1=Tf$ is satisfied regardless of Tr, the first gray scale range being in a lower side of a whole gray scale range and the second gray scale range being in a higher side of the whole gray scale range.

2. The display apparatus as set forth in claim 1, wherein said T2 is generated as a gray scale of the second sub-frame.

3. The display apparatus as set forth in claim 1, wherein $T1-Tf<(Tr-Tf)\times 0.1$ is further satisfied.

4. The display apparatus as set forth in claim 1, including a VA type liquid crystal panel.

5. A television receiver comprising:

the display apparatus as set forth in claim 1; and a tuner section for receiving a television broadcast.

6. A display apparatus including a signal processing section which generates gray scales corresponding to first through nth sub-frames into which one frame is divided, wherein, in a decay response in which a gray scale of a previous frame is Tf and a gray scale of a subsequent frame is Tr, the signal processing section is configured to generate T1, which is a gray scale corresponding to a first sub-frame of the subsequent frame, and T2, which is a gray scale corresponding to any one of a second through nth sub-frames of the subsequent frame, said T1 and T2 satisfying inequalities: (i) $T1 \leqq Tf$, (ii) $T2 \leqq Tr$, and (iii) $Tf-T1<T1-T2$, and $Tf-T1<(Tf-Tr)\times 0.1$ is further satisfied.

7. The display apparatus as set forth in claim 6, wherein said T2 is generated as a gray scale of the second sub-frame.

8. A television receiver comprising:

a display apparatus as set forth in claim 6; and a tuner section for receiving television broadcast.

9. A method for driving a display panel comprising:

generating gray scales corresponding to a first through nth sub-frames into which one frame is divided; and driving a display panel by use of the gray scales thus generated, wherein, in a rising response in which a gray scale of a previous frame is Tf and a gray scale of a subsequent frame is Tr, T1 and T2 satisfy inequalities: (i) $T1 \geqq Tf$, (ii) $T2 \geqq Tr$, and (iii) $T1-Tf<T2-T1$, where T1 is a gray scale generated so as to correspond to a first sub-frame of the subsequent frame, and T2 is a gray scale generated so as to correspond to any one of a second through nth sub-frames of the subsequent frame, and if said Tf is included in a first gray scale range, said T1 increases as said Tr increases, and if said Tf is included in a second gray scale range, $T1=Tf$ is satisfied regardless of Tr, the first gray scale range being in a lower side of a whole gray scale range and the second gray scale range being in a higher side of the whole gray scale range.

10. A method for driving a display panel comprising:

generating gray scales corresponding to a first through nth sub-frames into which one frame is divided; and driving a display panel by use of the gray scales thus generated, wherein, in a decay response in which a gray scale of a previous frame is Tf and a gray scale of a subsequent frame is Tr, T1 and T2 satisfy inequalities: (i) $T1 \leqq Tf$, (ii) $T2 \leqq Tr$, and $Tf-T1<T1-T2$, where T1 is a gray scale generated so as to correspond to a first sub-frame of the subsequent frame, and T2 is a gray scale generated so as to correspond to any one of a second through nth sub-frames of the subsequent frame and $Tf-T1<(Tf-Tr)\times 0.1$ is further satisfied.

* * * * *